US008769914B2

(12) United States Patent
Pape

(10) Patent No.: US 8,769,914 B2
(45) Date of Patent: Jul. 8, 2014

(54) METHOD FOR PACKAGING SHIRT AND TIE COMBINATIONS WITH A NOTCHED COLLAR SUPPORT AND TIE STRAP

(75) Inventor: Olivier Hans Pape, Plano, TX (US)

(73) Assignee: The Apparel Group, Ltd., Lewisville, TX (US)

( * ) Notice: Subject to any disclaimer, the term of this patent is extended or adjusted under 35 U.S.C. 154(b) by 584 days.

(21) Appl. No.: 12/930,447

(22) Filed: Dec. 14, 2009

(65) Prior Publication Data

US 2011/0167770 A1 Jul. 14, 2011

(51) Int. Cl.

| | |
|---|---|
| ***B65B 25/20*** | (2006.01) |
| ***B65D 85/18*** | (2006.01) |
| ***A41D 25/04*** | (2006.01) |
| ***A41B 3/12*** | (2006.01) |
| *B65B 63/04* | (2006.01) |

(52) U.S. Cl.

CPC ..... *B65B 25/20* (2013.01); *A41D 25/04* (2013.01); *A41B 3/12* (2013.01); *B65B 63/045* (2013.01); *B65D 85/182* (2013.01)

USPC ..... 53/445; 206/278; 229/87.17; 24/49.1; 24/66.11; 2/145

(58) Field of Classification Search

CPC .... B65D 85/18; B65D 85/182; A41D 25/022; A41B 3/12

USPC ..... 53/474, 445; 206/278, 769, 293; 24/49.1, 66.11; 2/148, 150; 223/83, 82; 422/400; 424/78.1; 229/87.17

IPC B65D 85/18; A41D 25/00, 25/02, 25/04; B65B 25/20

See application file for complete search history.

(56) References Cited

U.S. PATENT DOCUMENTS

| | | | | | |
|---|---|---|---|---|---|
| 1,297,311 | A | * | 3/1919 | Bacher | 248/450 |
| 2,099,269 | A | * | 11/1937 | Hoffman | 223/82 |
| 2,110,054 | A | * | 3/1938 | Pitcher | 24/66.2 |
| 2,504,887 | A | * | 4/1950 | Scott | 2/153 |
| 2,551,863 | A | * | 5/1951 | Young | 2/115 |
| 3,506,978 | A | * | 4/1970 | Santona | 2/150 |
| 3,738,548 | A | * | 6/1973 | Lojinger | 223/83 |
| 3,831,201 | A | * | 8/1974 | Burny, Jr. | 2/150 |
| 3,964,105 | A | * | 6/1976 | Gideon | 24/49.1 |
| 4,046,253 | A | * | 9/1977 | Weaver | 206/278 |
| 4,159,542 | A | * | 7/1979 | Pehr | 24/66.4 |
| 4,173,792 | A | * | 11/1979 | Intengan | 2/144 |
| 7,096,509 | B2 | * | 8/2006 | Kim | 2/145 |
| 7,310,857 | B2 | * | 12/2007 | Kim | 24/17 A |

(Continued)

FOREIGN PATENT DOCUMENTS

| | | | | | |
|---|---|---|---|---|---|
| FR | 508210 | A1 | * | 10/1920 | A41B 3/12 |
| FR | 1496556 | A1 | * | 9/1967 | B65D 85/182 |

(Continued)

*Primary Examiner* — Stephen F Gerrity

(74) *Attorney, Agent, or Firm* — Strasburger & Price, LLP

(57) ABSTRACT

A v-shaped shirt collar insert made of various materials placed around the neck of a packaged dress shirt such that the v-shape will support a neck tie for display. After a neck tie is folded around the v-shaped collar insert, a strap made of various materials is placed around the neck tie to gather the material of the neck tie to create the appearance of a "knotted" neck tie. The shirt and tie combination are then placed in a cardboard or plastic package to display the shirt and tie combination.

7 Claims, 3 Drawing Sheets

(56) References Cited

U.S. PATENT DOCUMENTS

| | | | | |
|---|---|---|---|---|
| 7,621,393 | B2 * | 11/2009 | Kim | 206/278 |
| 7,716,750 | B2 * | 5/2010 | Sato | 2/152.1 |
| 7,762,392 | B2 * | 7/2010 | Kim | 206/278 |
| 8,065,746 | B2 * | 11/2011 | Keeter | 2/129 |
| 2004/0187187 | A1 * | 9/2004 | Morrison-Gale | 2/144 |
| 2005/0287107 | A1 * | 12/2005 | Tuccelli | 424/78.1 |

FOREIGN PATENT DOCUMENTS

| | | | | |
|---|---|---|---|---|
| FR | 2115511 | A1 * | 7/1972 | A41D 25/022 |
| JP | 08156985 | A * | 6/1996 | B65D 85/18 |
| JP | 11256412 | A * | 9/1999 | A41D 25/00 |
| JP | 2006144206 | A * | 6/2006 | A41D 25/02 |
| WO | WO 9513712 | A1 * | 5/1995 | A41D 25/02 |

* cited by examiner

METHOD FOR PACKAGING SHIRT AND TIE COMBINATIONS WITH A NOTCHED COLLAR SUPPORT AND TIE STRAP

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable

FIELD OF THE INVENTION

The present invention relates generally to creating the appearance of a knotted tie for packaging shirt and tie combinations.

BACKGROUND OF THE INVENTION

Displaying a manufactured necktie and shirt together is a common practice for retailers. Retailers are requesting different available and low cost methods for packaging and displaying this combination. Most shirts have packaging inside the shirt provided by manufacturers for display compromised of rigid cardboard or plastic collar supports, collar bands, collar butterfly, shirt boards, collar stays, and other packaging. These items keep the shirt rigid for better display of the shirt in a retail operation. In addition to the shirt display, the necktie placed in the same packaging with the shirt requires a method to hold the necktie in place with the shirt to keep the necktie properly aligned.

An existing solution to this problem is to add materials to the packaging process to display the shirt and tie combination. The present invention provides needed improvements in this field by utilizing a v-shaped (or u-shaped) collar support and adding minimal packaging materials to create the appearance of a knotted tie.

SUMMARY OF THE INVENTION

According to one or more embodiments of the present invention is a shirt and tie packaging combination. The combination comprises a shirt having a shirt collar and a necktie. The necktie and shirt combination are package together by folding the tie over a notched cardboard collar insert (e.g., u or v-shaped) and gathering the fabric of the tie with a strap to create the appearance of a shirt with a tie. The shirt and tie combination are then placed in a cardboard or plastic package to display the shirt and tie combination. This method minimizes the use for additional packaging materials.

DETAILED DESCRIPTION OF THE PREFERRED EMBODIMENTS

Figure 1:
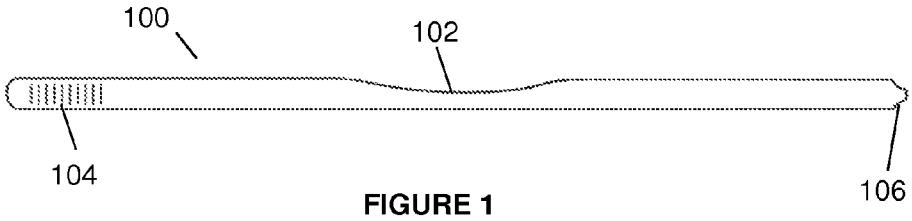
FIG. 1 is a view of the u-shaped cardboard or plastic collar insert with adjustable locking tab according to one more embodiments of the present invention.

FIG. 1 is a front view of a u-shaped collar support according to one or more embodiments of the present invention. The u-shaped collar support 100 is comprised of a plastic, a nylon, or a cardboard material. The support 100 includes a u-shape notch 102. Slots 104 are provided on one end of the support 100 and a tab 106 for engaging one of the slots 104. Consequently, the length of the support 100 may be adjusted to accommodate the shirt's neck band (not shown).

Figure 9:
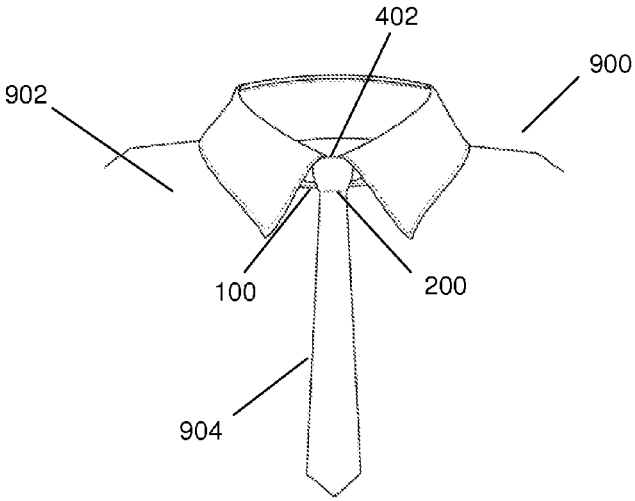
FIG. 9 is a front view of the shirt with the tie strap tightened to created the appearance of a "knotted tie" according to one more embodiments of the present.

FIG. 9 is a front view of a necktie and shirt combination 900 according to one or more embodiments of the present invention. A collared shirt 902 has a common packaged shirt fold suitable for display. A necktie 904 is added to the shirt 902 by folding it and laying it on top of the shirt. Details regarding the packaging of the shirt and tie combination follow.

Figure 3:
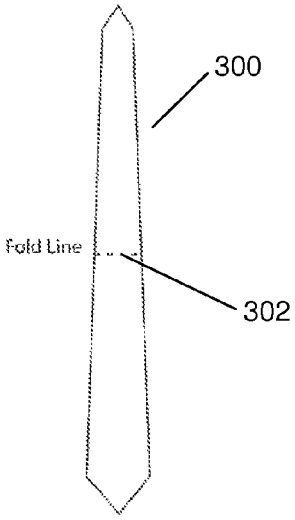
FIG. 3 is a view of a tie with an indication of the first fold line from the front view; according to one more embodiments of the present invention.

According to one or more embodiments of the present invention, FIGS. 3 through 6 illustrate uses of a collar support in connection with a tie and collared shirt combination for display. FIG. 3 illustrates a tie according to one or more embodiments of the present invention. The tie 300 includes a fold line 302 which is generally near the middle of the length of the tie 300.

Figure 4:
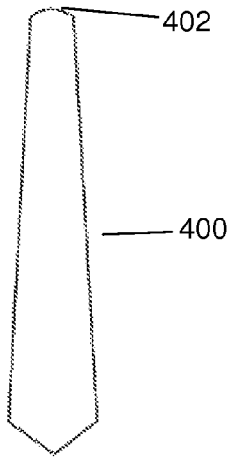
FIG. 4 is a view of a folded tie after the first fold according to one more embodiments of the present invention.

FIG. 4 illustrates a tie 400 when in a folded position along the fold line 302. A crease 402 of the folded tie 400 is also shown.

Figure 5:
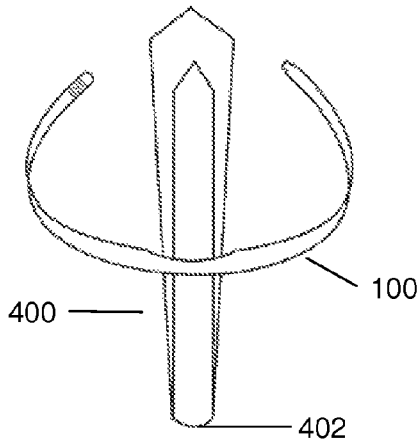
FIG. 5 is a view of the placement of the u-shaped cardboard or plastic collar insert with adjustable locking. tab placed in the first fold and folded again for proper alignment according to one more embodiments of the present invention.

FIG. 5 illustrates the folded tie 400 and the collar support 100.

Figure 6:
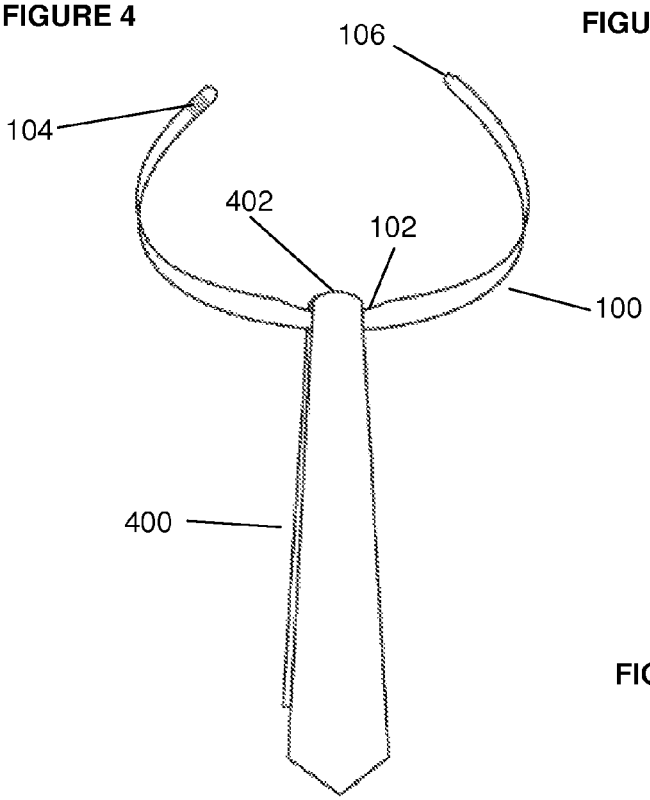
FIG. 6 is a front view of the folded tie with the u-shaped cardboard or plastic collar insert with adjustable locking tab ready for placement on the shirt according to one more embodiments of the present invention.

FIG. 6 illustrates the tie 400 engaging the collar support 100. So as to create the appearance of a neatly placed tie on the neck band of the shirt (not shown), the crease of the tie 402 is placed over the notch 102 of the collar support 100.

Figure 7:
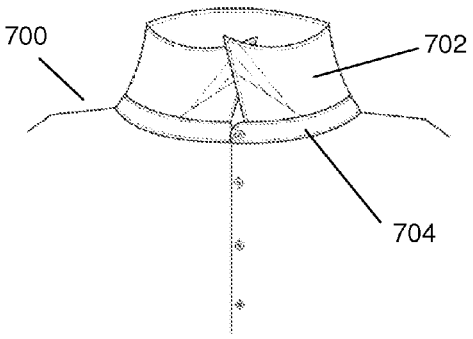
FIG. 7 is a view of the shirt with the collars folded up, ready to accept the v-shaped cardboard or plastic collar insert with adjustable locking tab according to one more embodiments of the present invention.

FIG. 7 illustrates a collared shirt 700 according to one or more embodiments of the present invention. A collar of the shirt 702 is flipped up to show a outer surface of a neck band 704 of the shirt 700. As discussed below, the collar support and folded tie are then inserted along the neck band of the shirt.

Figure 8:
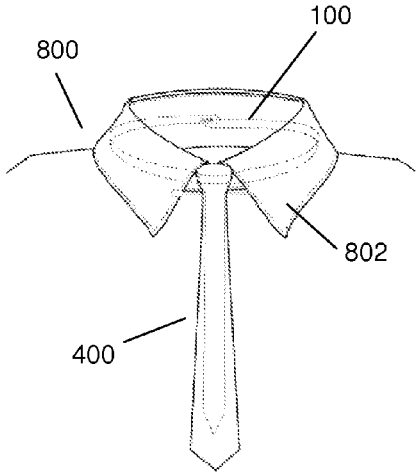
FIG. 8 is a front view of the shirt with the v-shaped cardboard or plastic collar insert with adjustable locking tab placed and locked in the back of the collar and the collars folded down according to one more embodiments of the present invention.

FIG. 8 illustrates the folded tie and collar support engaging the collared shirt according to one or more embodiments of the present invention. The folded tie 400 and the collar support 100 are shown engaging the outer surface of the neck band (not shown) of the shirt 800. The collar 802 of the shirt 800 is folded downward in the collar's normal position ready for display. The collar support 100 is adjustable to fit the circumference of the neck band of the shirt and maintain the folded tie in place.

Figure 2:
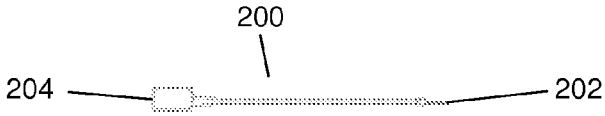
FIG. 2 is a view of the tie strap according to one more embodiments of the present invention.

FIG. 2 illustrates a strap according to one or more embodiments of the present invention. A strap 200 includes a locking mechanism (or open base) 204 and a tab (or tip) 202. The strap 200 consists of a sturdy nylon, plastic, or metal strap with an integrated open base on one end. Once the pointed tip 202 of the strap 200 has been pulled through the base 204. it is prevented from being pulled back; the resulting strap may only be pulled tighter. The strap 200 can be any color as well as clear or opaque.

As shown in FIG. 9, the strap 200 gathers (or cinches) the necktie 904 overhanging the collar support 100 to create the appearance of a knotted tie. The strap 200 is positioned on the necktie 904 close to the crease 402 not far below the most top button of the shirt (see FIG. 7). The strap 200 gathers the necktie 904 to create the appearance of a knotted tie.

In use, the shirt with a collar is combined with a necktie in a package. The necktie and shirt combination are packaged together by folding the tie over the notch (v-shape, u-shape) of the collar support and gathering (or cinching) the fabric of the folded tie with a strap to create the appearance of a shirt with a knotted tie. The shirt and tie combination are then placed in a cardboard or plastic package to display the shirt and tie combination. This method minimizes the use for additional packaging materials.

The invention has been described in connection with a particular embodiment thereof but is defined solely by the claims appended hereto.

What is claimed is:

1. A method for packaging a necktie and shirt for display comprising the steps of:

folding the necktie over a notch in a collar support;

securing the collar support around an outer surface of a neckband of said shirt;

gathering a portion of the necktie with a strap to create an appearance of a knotted tie; and placing the necktie and shirt in a package.

2. The method of claim 1, wherein the notch is an U-shaped notch.

3. The method of claim 1, wherein the collar support is composed of a cardboard material.

4. The method of claim 1, wherein the collar support is composed of a nylon material.

5. The method of claim 1, wherein the strap is composed of a plastic material.

6. The method of claim 1, wherein the strap is composed of an opaque material.

7. The method of claim 1, wherein the package is comprised of a plastic and a cardboard.

* * * * *